US009605441B2

(12) United States Patent
Choi

(10) Patent No.: US 9,605,441 B2
(45) Date of Patent: Mar. 28, 2017

(54) TENT FRAME TOP CONNECTING STRUCTURE

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co. Ltd., Xiamen (CN)

( * ) Notice: Subject to any disclaimer, the term of this patent is extended or adjusted under 35 U.S.C. 154(b) by 0 days.

(21) Appl. No.: 14/292,024

(22) Filed: May 30, 2014

(65) Prior Publication Data

US 2015/0284974 A1 Oct. 8, 2015

(30) Foreign Application Priority Data

Apr. 2, 2014 (CN) ..... 2014 2 0157253 U

(51) Int. Cl.
*E04H 15/48* (2006.01)
*E04H 15/32* (2006.01)
*E04H 15/42* (2006.01)

(52) U.S. Cl.
CPC ..... *E04H 15/48* (2013.01); *E04H 15/32* (2013.01); *E04H 15/42* (2013.01)

(58) Field of Classification Search
CPC ..... E04H 15/48; E04H 15/405; E04H 15/42
USPC ..... 135/135, 147
See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy |
| 1,129,194 | A | 2/1915 | Hanley |
| 1,347,107 | A | 7/1920 | McCann |
| 2,113,118 | A | 4/1938 | Pyatt |
| 2,306,706 | A | 12/1942 | Lucas |
| 2,448,895 | A | 9/1948 | Lawrence |
| 2,530,765 | A | 11/1950 | Greenup |
| 2,555,220 | A | 5/1951 | Brown |
| 2,716,993 | A | 9/1955 | Codrick |
| 2,731,972 | A | 1/1956 | Braun |
| 2,948,287 | A | 8/1960 | Rupert |
| 2,962,034 | A | 11/1960 | Finlayson |
| 2,984,249 | A | 5/1961 | Sears, Jr. et al. |
| 3,054,413 | A | 9/1962 | Eshelman |

(Continued)

FOREIGN PATENT DOCUMENTS

| | | |
|---|---|---|
| CA | 2022369 A1 | 2/1991 |
| CN | 1030790 C | 1/1996 |

(Continued)

OTHER PUBLICATIONS

International Search Report, PCT Application No. PCT/CN2008/073142, Jan. 22, 2009.

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed is a tent frame top connecting structure comprising top levers movably connected to a connecting piece, connecting grooves, positioning grooves, sidewalls, lateral walls, a top portion, a bump stopper, and a moving fulcrum. Top levers serve as installation tools. The structure is simple and convenient to assemble.

7 Claims, 4 Drawing Sheets

(56) References Cited

U.S. PATENT DOCUMENTS

| | | | | |
|---|---|---|---|---|
| 3,333,373 | A | 8/1967 | Taylor et al. | |
| 3,738,378 | A | 6/1973 | Williams | |
| 3,766,932 | A * | 10/1973 | Sidis | E04B 1/1903 135/147 |
| 3,810,482 | A | 5/1974 | Beavers | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,944,321 | A | 7/1990 | Moyet-Ortiz | |
| 4,971,090 | A | 11/1990 | Uhl | |
| 4,998,552 | A | 3/1991 | Niksic et al. | |
| 5,263,507 | A | 11/1993 | Chuang | |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,771,654 | A | 6/1998 | Moore et al. | |
| 5,797,695 | A | 8/1998 | Prusmack | |
| 5,884,646 | A | 3/1999 | Ju | |
| 5,943,837 | A | 8/1999 | Esser et al. | |
| 6,021,795 | A | 2/2000 | Long et al. | |
| 6,032,430 | A | 3/2000 | Soukup | |
| 6,167,898 | B1 | 1/2001 | Larga et al. | |
| 6,283,136 | B1 | 9/2001 | Chen | |
| 6,286,530 | B1 | 9/2001 | Hussey | |
| 6,296,415 | B1 | 10/2001 | Johnson et al. | |
| 6,463,948 | B2 | 10/2002 | Lee | |
| 6,516,823 | B1 | 2/2003 | Glover et al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,772,780 | B2 | 8/2004 | Price | |
| 6,776,179 | B1 | 8/2004 | Chen | |
| 6,854,476 | B1 | 2/2005 | Chai | |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| 7,316,239 | B2 | 1/2008 | Yang | |
| RE40,544 | E | 10/2008 | Suh | |
| 7,481,235 | B2 | 1/2009 | Prusmack | |
| 7,546,845 | B2 | 6/2009 | Prusmack | |
| 8,156,952 | B2 * | 4/2012 | Chesness | E04H 15/001 135/123 |
| 8,186,369 | B2 * | 5/2012 | Reeb | E04H 15/48 135/135 |
| D705,884 | S | 5/2014 | Jin | |
| 8,910,648 | B2 | 12/2014 | Jin | |
| 2001/0050098 | A1 | 12/2001 | Lee | |
| 2003/0005953 | A1 | 1/2003 | Erbetta et al. | |
| 2007/0051399 | A1 | 3/2007 | Jung | |
| 2007/0215192 | A1 | 9/2007 | Hoffman | |
| 2012/0318316 | A1 * | 12/2012 | Choi et al. | 135/135 |
| 2013/0014794 | A1 | 1/2013 | Jin | |
| 2014/0076372 | A1 * | 3/2014 | Jin | E04H 15/46 135/139 |
| 2014/0109945 | A1 * | 4/2014 | Jin | 135/135 |
| 2014/0261601 | A1 | 9/2014 | Jin | |
| 2014/0290710 | A1 | 10/2014 | Choi | |
| 2015/0083177 | A1 | 3/2015 | Hotes | |
| 2015/0275541 | A1 * | 10/2015 | Lamke | E04H 15/46 135/139 |

FOREIGN PATENT DOCUMENTS

| | | | | |
|---|---|---|---|---|
| CN | 2506736 | Y | | 8/2002 |
| CN | 2635827 | Y | | 8/2004 |
| CN | 201129060 | Y | | 10/2008 |
| CN | 201220478761.4 | | | 9/2012 |
| CN | 202767622 | U | * | 3/2013 |
| CN | 202767622 | U | | 3/2013 |
| FR | 1 121 851 | | | 8/1956 |
| FR | 68588 | | | 5/1958 |
| GB | 2201703 | A | | 9/1988 |
| GB | 2259927 | A | | 3/1993 |
| WO | WO 2011/022764 | A1 | | 3/2011 |

* cited by examiner

TENT FRAME TOP CONNECTING STRUCTURE

CROSS-REFERENCE TO RELATED APPLICATION

The present application claims priority to Chinese Patent Application No. 2014-20157253.5 filed on Apr. 2, 2014, the entire contents of which is incorporated herein for all purposes by this reference.

FIELD OF THE INVENTION

The present utility model relates to a tent structure, and particularly to a tent frame top connecting structure.

BACKGROUND OF THE INVENTION

As an outdoor leisure product, the tent has been widely applied to various occasions. Generally, a tent frame is composed of several groups of support poles which are connected with top levers. The top levers form a top support. Each top lever is movably connected to a connecting piece at the top of the tent frame. In order to achieve unfolding and folding the tent, the connecting structure at the top of the tent is always complicated in structure, difficult to assemble, and high in cost.

Chinese Utility Model CN201220405537.2 discloses a tent top connecting piece. The tent top connecting piece is provided with pivoting open grooves which are radially arranged and have a number corresponding to that of the tent top levers. Pivoting holes are arranged to penetrate two sheet bodies of the pivoting open grooves. With this tent top connecting piece, it is required to mount a connector at the head of the top lever and cooperate with the tent top connecting piece. During assembly, it is further required to pivotally connect the connector and the top connecting piece with a pin. Thus, the assembly process is relatively complicated.

Chinese Utility Model CN201220367790.3 of the present applicant discloses a tent rest connecting structure, in which an open groove is formed in a connecting piece, and a longitudinal positioning groove is respectively formed on each inner side of two sheet bodies of the open groove in a concave mode. With this connecting structure, it is also required to mount a connector at the head of the top lever to cooperate with the connecting structure. Therefore, there remains room for further improvement.

Figure 1:
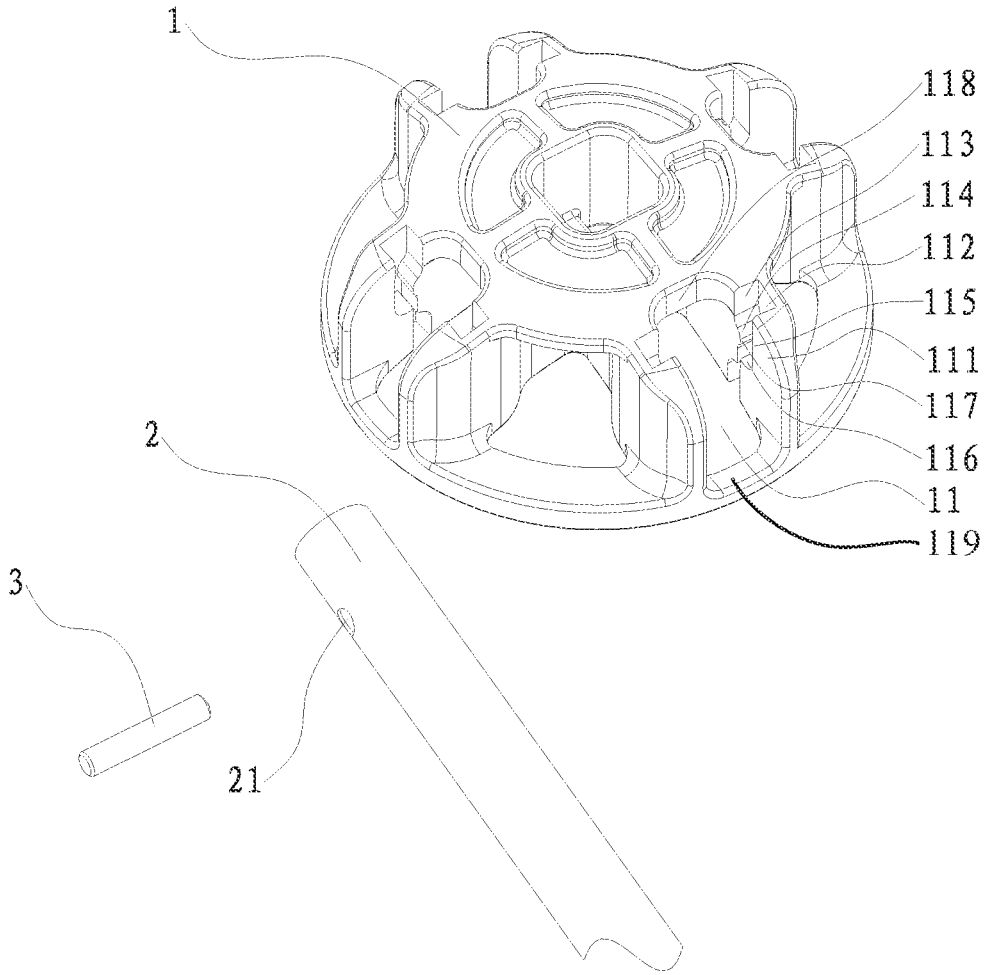
FIG. 1 is an exploded view showing parts in a tent frame top connecting structure.
Figure 2:
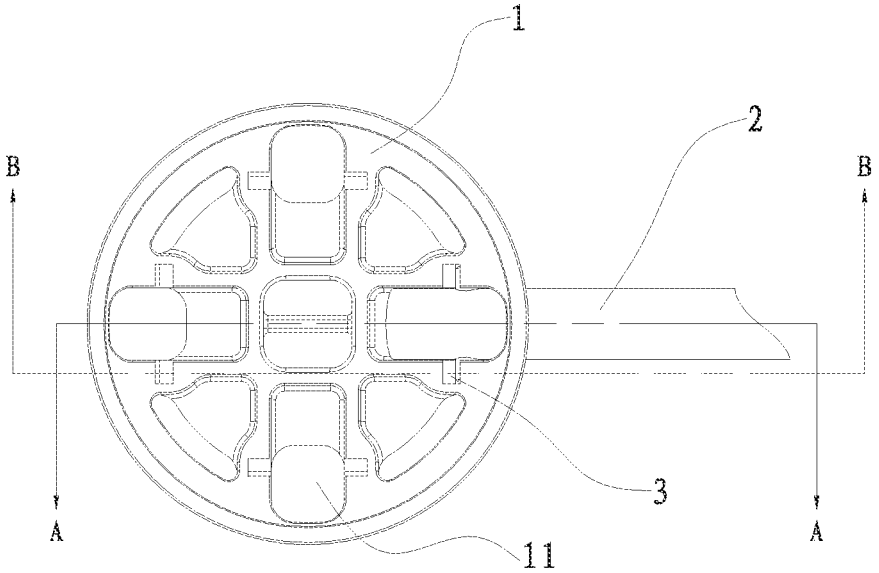
FIG. 2 is a bottom view of the tent frame top connecting structure.

The figures depict a connecting piece and one top lever. For clarity, depictions of other top levers are omitted throughout these figures.

Reference numerals used in the figures are identified as follows: connecting piece 1; connecting groove 11; sidewall 111; positioning groove 112; front longitudinal edge 113; curved stop surface 114; back longitudinal edge 115; curved surface 116; convex point 117; bump stopper 118; lateral wall 119; top lever 2; pin hole 21; and pin 3.

DETAILED DESCRIPTION

The present utility model will be described hereinafter by referring to the accompanying drawings and specific embodiments.

FIGS. 1-6 depict a tent frame top connecting structure comprising a connecting piece 1 and top levers 2. An inner end of top lever 2 having an inner-end cross-section is movably connected to connecting piece 1. The inner end of top lever 2 is provided with a pin hole 21 for receiving a pin 3 having a pin cross-section (e.g., a diameter) and a pin length. The pin length is such that both ends of pin 3 protrude from pin hole 21. Connecting piece 1 comprises connecting grooves 11, which are radially arranged and have a number corresponding to that of the top levers 2. Connecting grooves 11 cooperate with top levers 2. In one embodiment, connecting piece 1 comprises four connecting grooves 11 and four top levers 2. For simplicity of illustration, the figures illustrate an assembling relationship between connecting piece 1 and one of top levers 2; a skilled artisan will readily ascertain pertinent details relating to other top levers 2 not shown in the figures.

Connecting groove 11 includes a top portion, a lateral wall 119, and first and second sidewalls 111. Each sidewall 111 further comprises a longitudinal positioning groove 112 for engaging pin 3, and through which pin 3 can pass. The pin length is sufficient to engage both longitudinal positioning grooves 112. A bump stopper 118 is arranged at the top portion (e.g., including a mouth) of connecting groove 11. In the embodiments shown in FIGS. 1-6, the top portion and bump stopper 118 are co-extensive. In another embodiment, the bump stopper may be located adjacent to positioning grooves 112. In another embodiment, a bump stopper not co-extensive with the top portion may be located on sidewall 111. A curved stop surface 114 is formed on a front longitudinal edge 113 of positioning groove 112, and a curved surface 116 is formed on a back longitudinal edge 115 of positioning groove 112 as a moving fulcrum for pin 3. Curved stop surface 114 further comprises a convex point 117 located a first distance from curved surface 116, thereby forming a positioning space between convex point 117 and curved surface 116 sufficient to accommodate the pin cross section of pin 3. A second distance between convex point 117 and back longitudinal edge 115 of positioning groove 112 is smaller than the cross-section of pin 3.

Figure 6:
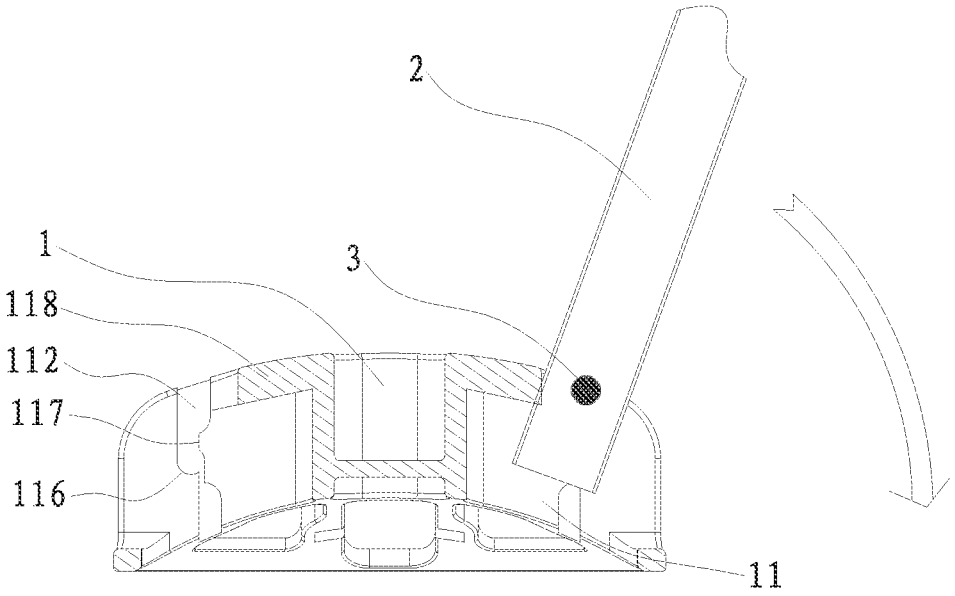
FIG. 6 is a cross-sectional view illustrating a process for assembling the tent frame top connecting structure.

Top lever 2 also serves as an installation tool. During assembly, pin 3 is inserted into pin hole 21 in top lever 2, preferably such that both ends of pin 3 protrude from pin hole 21. More preferably, both ends of pin 3 protrude to the same extent as one another from pin hole 21. Referring to FIG. 6, top lever 2, into which pin 3 has been inserted, is inserted downward (e.g., by rotating top lever 2 clockwise as indicated by the arrow in FIG. 6) into connecting groove 11 of connecting piece 1. Pin 3 moves along positioning groove 112 toward curved surface 116. When pin 3 passes convex point 117 on curved stop surface 114, convex point 117 and the surrounding material are elastically deformed to a certain extent. As a result, pin 3 is embedded and engaged in the positioning space for pin 3 between convex point 117 on positioning groove 112 and curved surface 116. In this way, top lever 2 and connecting piece 1 are assembled and movably connected.

Figure 3:
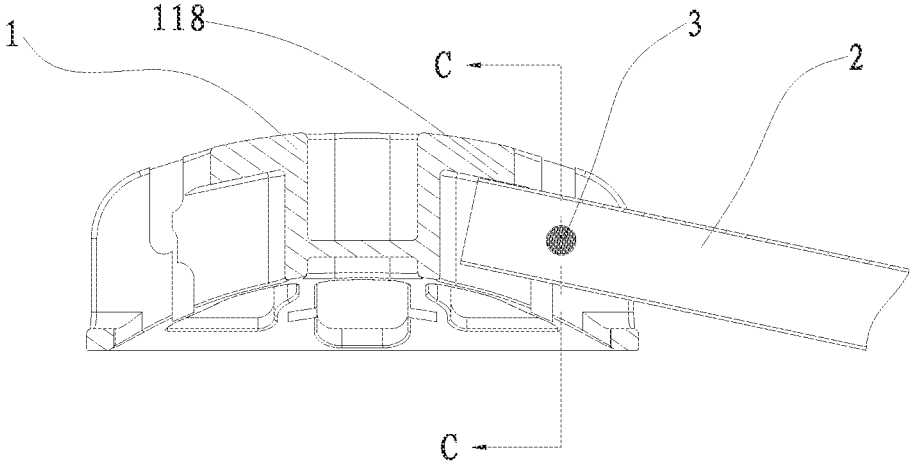
FIG. 3 is a cross-sectional view along the line A-A in FIG. 2.
Figure 4:
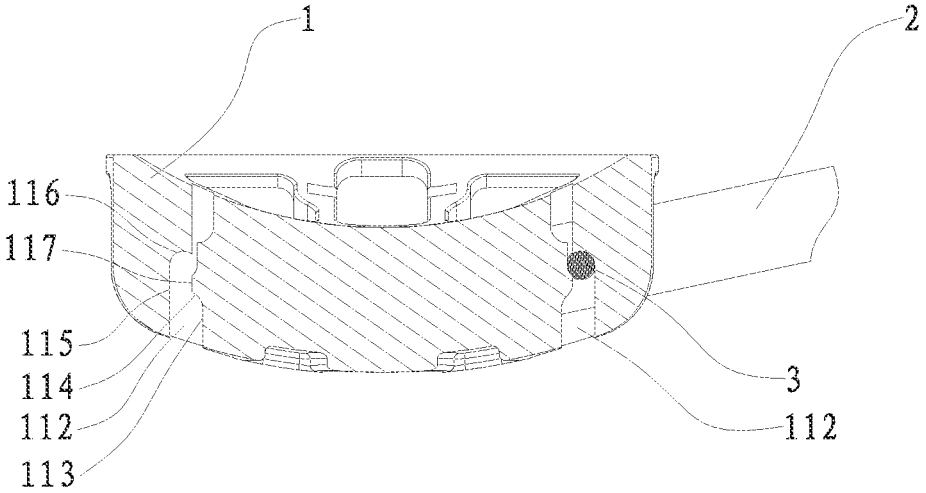
FIG. 4 is a cross-sectional view along the line B-B in FIG. 2.
Figure 5:
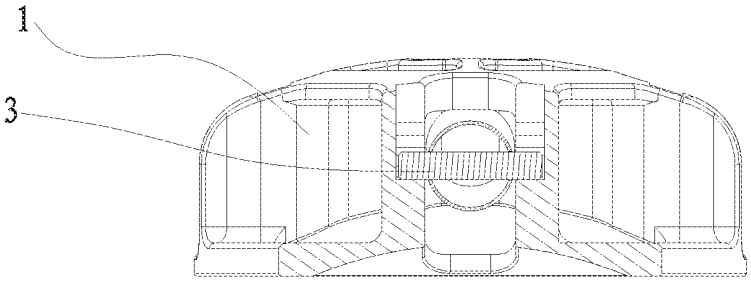
FIG. 5 is a cross-sectional view along the line C-C in FIG. 3.

In one embodiment, the connecting position between top lever 2 and connecting piece 1 indicates a connecting position for the tent frame in a folded state. To unfold the tent, top lever 2 is rotated downward, depicted as a clockwise rotation according to the arrow in FIG. 6, so that the inner end of top lever 2 rests against bump stopper 118 as depicted in FIG. 3. In this way, tent frame top levers 2 and connecting piece 1 can be unfolded as shown in FIG. 3, and the top frame connecting structure thereby enters the unfolded state.

Although the invention has been described in connection with specific embodiments, variations of these embodiments will be obvious to those of ordinary skill in the art. For example, more or fewer connecting grooves 11 and top levers 2 than described may be arranged on connecting piece 1, bump stopper 118 may be moved to a position adjacent to positioning grooves 112. In another embodiment, sidewall 111 may further comprise a bump stopper. Other modifications and variations likewise fall within the scope of the appended claims. Therefore, the spirit and scope of the claims should not be limited to the foregoing description.

Only those claims specifically reciting "means for" or "step for" should be construed in the manner required under the sixth paragraph of 35 U.S.C. §112.

What is claimed is:

1. A frame top connecting structure for selectively placing a tent frame in a folded state or an unfolded state, the frame top connecting structure comprising:

a connecting piece comprising a plurality of radially arranged connecting grooves, each connecting groove comprising a top portion, a lateral wall, first and second sidewalls, and for each sidewall, a longitudinal positioning groove recessed into the sidewall for engaging a pin, the pin having a pin cross-section and a pin length, the pin length sufficient to engage the longitudinal positioning grooves, the longitudinal positioning groove having a front longitudinal edge and a back longitudinal edge; and a plurality of top levers, each top lever having an inner end, the inner end having an inner-end cross-section and including a pin hole for receiving the pin, whereby each top lever is movably interconnected to a corresponding one of the longitudinal positioning grooves, wherein the lateral wall is formed at an outer periphery of a bottom portion of the corresponding connecting groove and between the first and second sidewalls of the corresponding connecting groove such that the lateral wall connects the first and second sidewalls of the corresponding connecting groove, and wherein the top portion is formed between the first and second sidewalls of the corresponding connecting groove and has a bottom surface sloping downward with respect to a central axis of the connecting piece, such that the inner end of a corresponding top lever rests against the bottom surface of the top portion in an unfolded state and the corresponding top lever tilts downward in the unfolded state.

2. The frame top connecting structure of claim 1, wherein:

the back longitudinal edge further comprises a curved surface, the curved surface serving as a moving fulcrum for the pin; and the front longitudinal edge further comprises a curved stop surface having a convex point, wherein the convex point located a first distance from the curved surface, thereby forming a positioning space between the convex point and the curved surface sufficient to accommodate the pin cross-section.

3. The frame top connecting structure of claim 2, wherein a second distance is formed between the convex point and the back longitudinal edge, the second distance smaller than the pin cross-section.

4. The frame top connecting structure of claim 1, the top portion further comprising a bump stopper.

5. The frame top connecting structure of claim 4, wherein the bump stopper is adjacent to the longitudinal positioning grooves.

6. The frame top connecting structure of claim 1, wherein the pin cross-section is round.

7. The frame top connecting structure of claim 1, wherein the inner-end cross-section is round.

* * * * *